US012543808B2

(12) United States Patent
Swaine

(10) Patent No.: US 12,543,808 B2
(45) Date of Patent: Feb. 10, 2026

(54) TRAVEL GARMENT

(71) Applicant: Steve Swaine, Granbury, TX (US)

(72) Inventor: Steve Swaine, Granbury, TX (US)

( * ) Notice: Subject to any disclaimer, the term of this patent is extended or adjusted under 35 U.S.C. 154(b) by 0 days.

(21) Appl. No.: 18/227,609

(22) Filed: Jul. 28, 2023

(65) Prior Publication Data

US 2024/0277088 A1 Aug. 22, 2024

Related U.S. Application Data

(60) Provisional application No. 63/446,752, filed on Feb. 17, 2023.

(51) Int. Cl.
*A41D 27/22* (2006.01)
*A41D 1/02* (2006.01)

(52) U.S. Cl.
CPC ..... *A41D 27/22* (2013.01); *A41D 1/02* (2013.01)

(58) Field of Classification Search
CPC ..... A41D 1/02; A41D 3/02; A41D 13/0007; A41D 19/0044; A41D 19/0048; A41D 27/10; A41D 27/28; A41D 27/285; A41D 15/00; A45C 13/26; A45C 13/28
USPC ..... 190/102
See application file for complete search history.

(56) References Cited

U.S. PATENT DOCUMENTS 1,436,854 A * 11/1922 Brady ..... G09F 3/20 40/586
4,969,214 A * 11/1990 Cohen ..... A41D 3/00 2/102
6,256,789 B1 * 7/2001 Young ..... E04G 5/001 244/151 R
6,637,562 B2 * 10/2003 Oh ..... A45C 13/002 190/102
7,093,699 B2 * 8/2006 Yu ..... A45C 13/002 150/154
7,458,452 B2 * 12/2008 Beakey ..... A45C 13/002 150/105
7,757,304 B1 * 7/2010 Real ..... A41D 13/0007 2/69
10,244,804 B2 * 4/2019 Hodgson ..... A41D 27/28
10,299,522 B2 * 5/2019 Kuo ..... A61F 5/3746
10,349,717 B2 * 7/2019 Hamzaee ..... A45C 13/28
10,433,594 B2 * 10/2019 Espili ..... A41D 13/02
10,485,314 B2 * 11/2019 Teran ..... A45C 5/06
11,129,423 B2 * 9/2021 Zeppetella ..... A41D 13/0007
D940,999 S * 1/2022 Moreau ..... D2/840
11,464,309 B2 * 10/2022 McKelvey ..... A47G 25/1442
2007/0017764 A1 * 1/2007 Cheng ..... A45C 13/002 190/100
2007/0068758 A1 * 3/2007 Nagata ..... A45C 13/262 190/115
2009/0158489 A1 * 6/2009 White ..... G09F 21/02 2/244

(Continued)

*Primary Examiner* — F Griffin Hall
(74) *Attorney, Agent, or Firm* — Donn K. Harms

(57) ABSTRACT

A garment for wearing during travel is provided which is configured for a removable positioning upon a suitcase having an elongated handle. The body of the garment includes a slot therein for communication of the elongated handle therethrough to hold the garment in the removable position upon the suitcase while it is stationary or being moved upon a support surface. Flaps having indicia thereon may be included to cover the slot while the garment is being worn by the user.

9 Claims, 5 Drawing Sheets

(56) References Cited

U.S. PATENT DOCUMENTS

| | | | | |
|---|---|---|---|---|
| 2010/0270115 | A1* | 10/2010 | Seamon | A45C 13/002<br>190/26 |
| 2011/0259692 | A1* | 10/2011 | Warncke | A45C 13/002<br>190/124 |
| 2012/0006638 | A1* | 1/2012 | Semersky | A45C 13/28<br>223/89 |
| 2012/0199594 | A1* | 8/2012 | Pernarella | A45C 13/42<br>220/694 |
| 2016/0066669 | A1* | 3/2016 | Lien | A45C 13/002<br>206/459.5 |
| 2020/0352296 | A1* | 11/2020 | Bent | A45C 5/14 |

* cited by examiner

TRAVEL GARMENT

This application claims priority to U.S. Provisional Patent Application Ser. No. 63/446,752 filed on Feb. 17, 2023 which is incorporated herein in its entirety by this reference thereto.

FIELD OF THE INVENTION

The present device relates to traveling and luggage. More particularly, the disclosed device relates to a garment which is worn on the upper body of the user, such as a jacket or sweater, which is configured for removable but secure positioning upon the exterior of a suitcase.

BACKGROUND OF THE INVENTION

The term carry-on luggage or cabin baggage (normally called carry-on in North America) refers to the type of luggage that passengers are allowed to carry along in the passenger compartment of an aircraft rather than that which is stowed in the cargo hold of the airplane. Conventionally, passengers are allowed to carry a limited number of smaller bags with them in the cabin of the aircraft, which typically contain valuables and items which may be needed during the journey.

For business travelers who fly frequently and change planes at multiple airports, carry-on luggage may in fact be the sole luggage which they bring on a given trip. Bringing luggage on the aircraft alleviates the issues with lost luggage and having to wait at luggage turnstiles to retrieve their bag after every trip or leg of such trips.

However, be they business travelers or vacationers who seldom travel, moving through the airport with a carry-on bag in hand can result in other issues. For example, when checking in at the airline counter, or moving through airport security, frequently travelers must present identification or other documents. When carrying a jacket or the like, the need to hold the jacket while searching pockets for identification or boarding passes and the like, can be a clumsy procedure. Frequently, it results in dropped documents or dropped jackets due to the need to hold on to their carry on suitcase along with the jacket or sweater while they search pockets for the desired or required document.

The forgoing background concerning conventional carry-on luggage and clothing used by travelers, and the limitations related therewith, are intended to be illustrative and not exclusive, and they do not imply any limitations on the invention described and claimed herein. Various other limitations of the related art in carry-on luggage and clothing used by travelers are known or will become apparent to those skilled in the art upon a reading and understanding of the specification below and the accompanying drawings.

SUMMARY OF THE INVENTION

The travel garment device and system herein disclosed provides users a wearable garment which is configured for temporary removable engagement with a suitcase or travel bag or the like, when needed rather than having to carry the garment when not being worn. The garment features a body portion configured for wearing on the upper body of the user, such as a jacket, sweater, sweatshirt, hoodie, or other similar configured garments having a body portion to which sleeves for the arms are engaged.

The body portion includes a slot formed through the rear wall of the body portion. The slot is configured for the passage of a handle of the suitcase or bag therethrough during positioning of the travel garment atop the suitcase in an as-used positioning.

In a particularly preferred mode of the garment device herein, a flap is positioned upon the exterior surface of the rear wall of the body portion of the travel garment. The flap is attached in a manner wherein in a first or default position it covers over the slot formed through the rear wall of the body of the travel garment. This first or default positioning of the flap both covers the slot for aesthetic purposes as well as to prevent drafts from communicating through the slot. The slot is foldable to a second position wherein the slot is uncovered and viewable by the user during positioning by the user of the handle therethrough.

In a mode of the garment device adapted for advertising, the exterior surface of the flap can have indicia thereon. The indicia may be in the form of artwork, or advertising, a designation of travel group, or other configurations wherein advertising fees may be payable to the user for wearing a travel garment having such indicia positioned upon the flap. In this mode also, the flap may be removably engaged along one edge to the body of the travel garment. This will allow for the positioning on such travel garments of one of a plurality of flaps having differing indicia thereon.

For example only and in no way limiting, such flaps might be provided by a tour service or advertiser to one or a group of travelers, wherein they have indicia thereon relating to the trip or the products of the advertiser or the services provided by a travel service. Or, where the garment is worn by members of a group traveling together, the flap can include indicia, such as text or color or both, which identifies the group, so members can discern other members and assemble.

While the garment device may only have a body portion, it is anticipated most such garment devices will also have sleeves extending therefrom for the arms of the user. In the preferred mode of the garment device herein, to allow the garment device to fold over and cover the top of the suitcase with a handle communicating through a slot in the body, the sleeves may either engage into pockets sized to frictionally hold them, or they may have a fastener thereon which removably connects to a mating fastener upon the body portion of the garment. The fasteners may be any that would occur to those skilled in the art which will form a removable connection between the distal end of each sleeve and a respective side of the body portion adjacent it. Such, for example and in no way to be considered limiting, may be buttons and bottom holes, snaps, hook and loop fabric, hooks, screws, push pins, a sleeve opening formed into the body, and other mating fasteners which allow the user to removably connect each sleeve to the body.

In use, with the distal ends of sleeves, where present, removably connected by sleeve fasteners to the body of the garment, the user will align the handle with the slot formed in the rear portion thereof. The user will then guide the handle through the slot in the rear portion or panel. With the handle communicating through the slot, the user can drape the body portion of the garment over the top surface of the suitcase. Because the distal ends of the sleeves are removably connected to the body portion at an elevation above a lower edge thereof, they will fold or assume an upward curve which will keep the distal ends of both from contacting the floor. This prevents the sleeves from getting dirty, as well as keeping them both elevated and out of the path of any wheels which may be engaged to the suitcase to roll it.

In this draped positioning, with the handle engaged through the slot, the garment is held secure with the user holding or rolling the suitcase. This draped positioning allows the user to easily find and present any documents, such as identification and boarding passes and the like, and not worry about holding onto the travel garment. Further, the travel garment is also not easily lost or stolen which is especially preferred when the garment is one that is worn by a child.

Once the user no longer needs to stow the travel garment, it may be easily removed by sliding off of engagement between the slot and the handle. Thereafter, the two sleeves are easily disconnected from the body of the garment, and it may be worn or carried by the user.

With respect to the above description, before explaining at least one preferred embodiment of the herein disclosed travel garment device configured for removable engagement to a suitcase in detail, it is to be understood that the invention is not limited to the details of construction and to the arrangement of the components in the following description or illustrated in the drawings. The travel garment herein described and disclosed is capable of other embodiments and of being practiced and carried out in various equivalent ways which will become obvious to those skilled in the art subsequent to reading this disclosure. Also, it is to be understood that the phraseology and terminology employed herein are for the purpose of description and should not be regarded as limiting.

As such, those skilled in the art will appreciate that the conception upon which this travel garment disclosure is based, may readily be utilized as a basis for the designing of other substantially equivalent travel garment structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. The term "substantially", unless otherwise specifically defined, means plus or minus five percent.

It is an object of the present invention to provide a travel garment worn on the upper body which is configured for removable, yet secure positioning, upon a suitcase or bag.

It is an additional object of this invention to provide such a travel garment which has a passage therethrough for positioning on the handle extending from a rolling bag or suitcase.

These and other objects, features, and advantages of the present travel garment invention, as well as the advantages thereof over existing prior art, which will become apparent from the description to follow, are accomplished by the improvements described in this specification and hereinafter described in the following detailed description which fully discloses the travel garment invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the travel device and system herein. It is intended that the embodiments and figures disclosed herein are to be considered illustrative of the invention herein, rather than limiting in any fashion.

Figure 4:
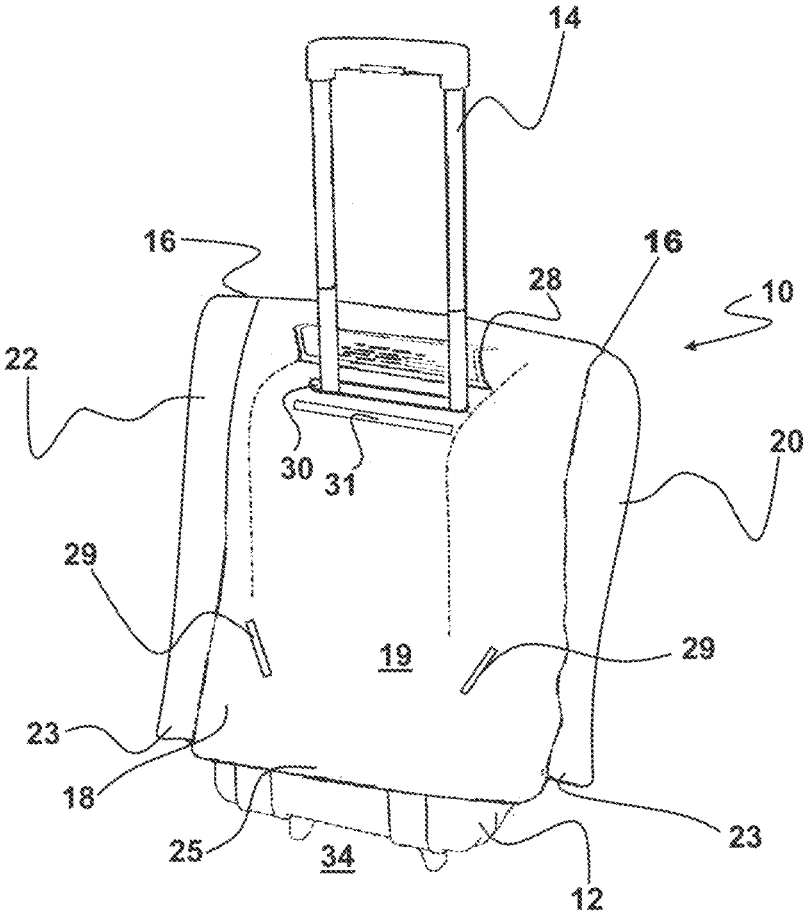
FIG. 4 shows the travel garment herein operatively located to an engaged position with a suitcase wherein it drapes over the top surface of a suitcase or bag once the handle is positioned through the slot in the body, and the distal ends of the sleeves are held elevated by their removable connection to the body.
Figure 5:
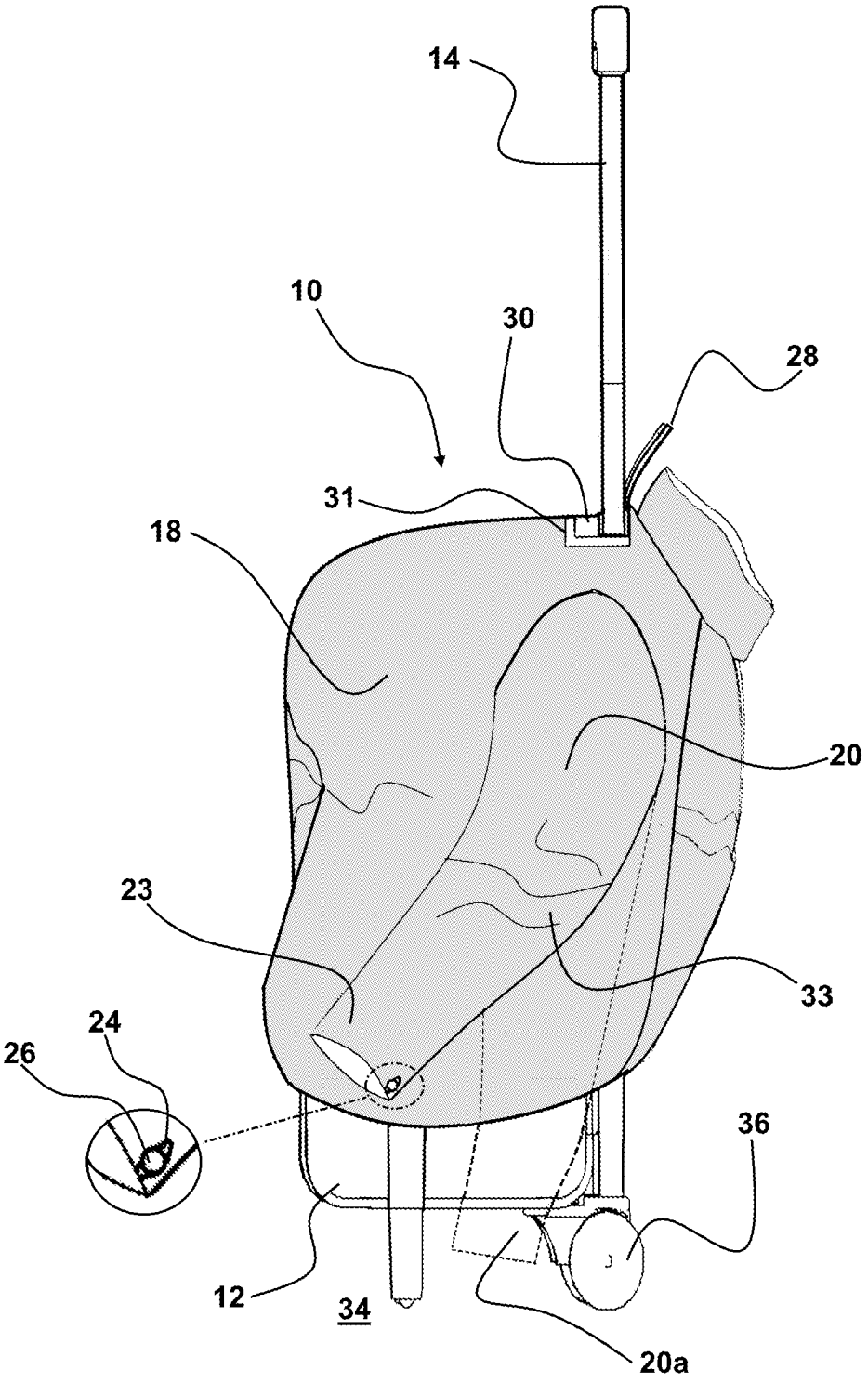

FIG. 5 depicts the travel garment herein in a side view to that of FIG. 4 and shows the preferred body and sleeve fasteners removably holding the distal ends of the two sleeves to form an upward curve or folded position thereof, while the travel garment is in the engaged position. Also shown is the position of an unattached sleeve, in dotted line, to depict their positioning should they not be so removably engaged.

DETAILED DESCRIPTION OF THE INVENTION

In this description, the directional prepositions of up, upwardly, down, downwardly, front, back, top, upper, bottom, lower, left, right, first, second, and other such terms refer to the travel garment device as it is oriented and appears in the drawings and all such terms are used for convenience only and such are not intended to be limiting or to imply that the travel garment device has to be used or positioned in any particular orientation.

Figure 1:
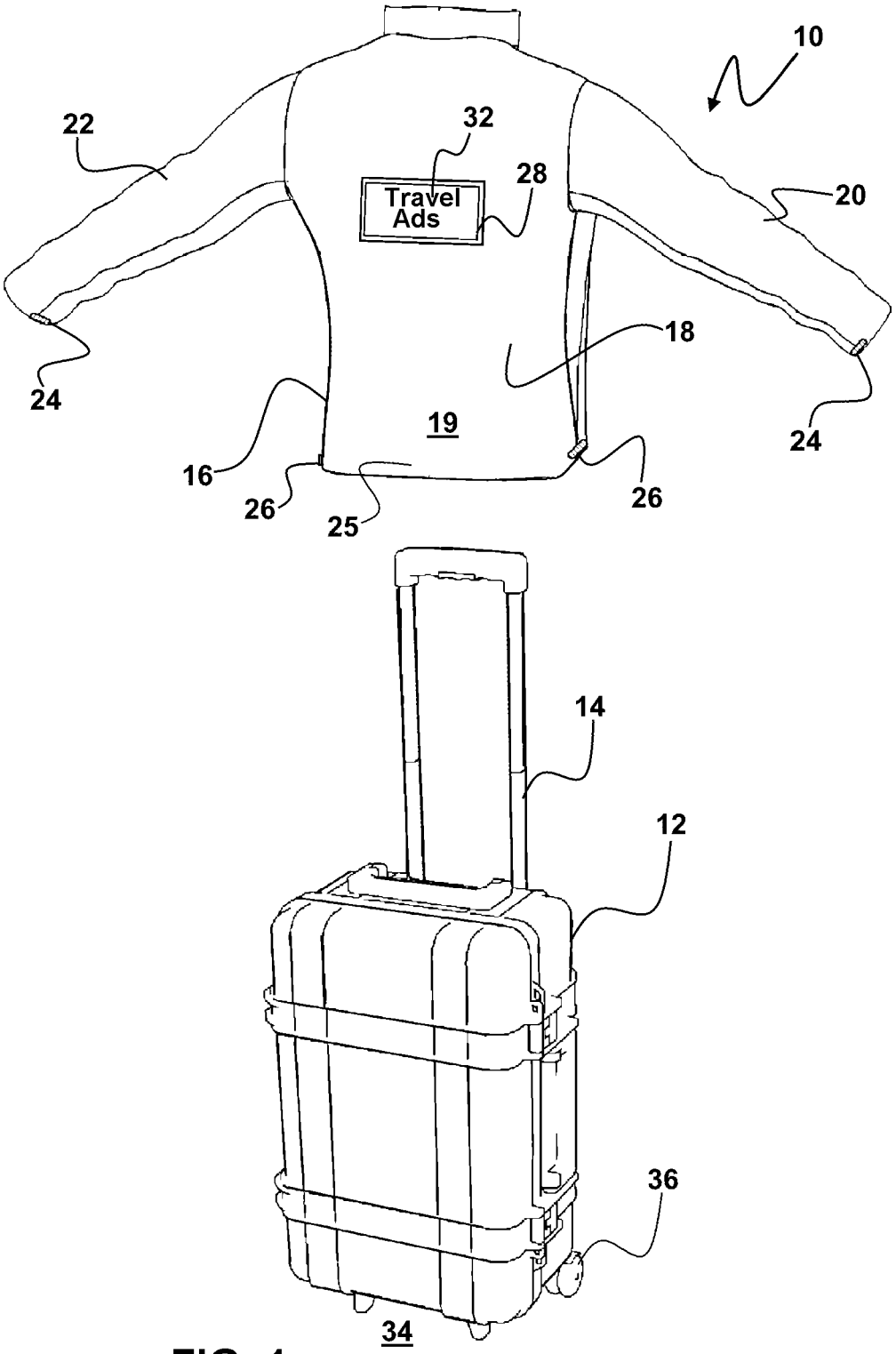
FIG. 1 depicts a perspective view of the travel garment device herein positioned for engagement upon a suitcase or bag having a handle extending therefrom.

Now referring to drawings in FIGS. 1-5, wherein similar components are identified by like reference numerals, there is seen in FIG. 1 a perspective view of the travel garment device 10 herein positioned to be engaged upon a suitcase 12 or bag having an elongated handle 14 extending therefrom. While the term suitcase 12 is used herein for convenience, it is meant to include any travel type bag having a fixed or elongated handle 14 connected thereto. By elongated handle 14 is meant any fixed or telescopic handle which extends a distance above a suitcase which the user employs to move the suitcase about. The elongated handle 14 may be permanently elongated or it may be telescopic in configuration in a conventional manner allowing the handle to collapse when not in use.

The travel garment device 10 has a body portion 16 having a rear side 18 opposite a front side which may or may not be open. The body portion 16 is configured for wearing upon the torso of a user in a conventional manner for a jacket or the like. The body portion 18 has a front side which opens for the user to pull the body portion 18 over their torso after inserting their arms into the sleeves. Such a configuration is well known, where the front portion has buttons or snaps or a zipper or the like to secure two half portions of the front side.

In a preferred mode of the travel garment device 10 herein the body portion 16 has a first sleeve 20 and a second sleeve 22 operatively engaged with opposite sides of the body portion 16. The first sleeve 20 hangs from a first side of the body portion 16 and the second sleeve hangs from the opposite or second side of the body portion 16.

Each of the first sleeve 20 and second sleeve 22, in this mode of the travel garment device 10, in a most preferred mode of the device, has a sleeve fastener 24 positioned at or adjacent the distal end 23 thereof. Each of the sleeve fasteners 24 is removably engageable to a mating body fastener 26 positioned upon the body portion 16 of the travel garment device 10. Alternatively, the distal end 23 of each of the sleeves 20 and 22 can be slid into a sleeve pocket 29 which may be part of or formed into the body portion 16. As noted, the body fasteners 26 and/or the sleeve pockets 29 must be positioned above the lower edge 25 a sufficient distance to hold the distal ends 23 and other areas of the sleeves out of contact with the roller 36 or the support surface 34.

The sleeve fasteners 24 and mating body fasteners 26 may, as noted above, be any that would occur to those skilled in the art which will provide removable securement of the distal end 23 of the sleeves 20 and 22 to the body portion 16. Such releasable mating fasteners, such as sleeve fasteners 24 and mating body fasteners 26 may include sleeve pockets 29 or button holes on one of the sleeve 20 or 22 or the body portion 16, which are engageable with a button on the other.

Also included, as sleeve fasteners, are hook and loop fabric positioned on the sleeves 20 and 22 and body portion 16, or magnets on both the sleeves 20 and 22 and the body portion, or snaps on one of the sleeve or body portion engageable with mating snaps on the other. Other releasable mating fasteners useable to engage the distal end of the first sleeve 20 and second sleeve 22, to place the sleeves in a folded configuration, while engaged to the body portion 16 may be employed, so long as they form an easily removed engagement and locate the distal ends 23 and curved or folded portions of each sleeve 20 and 22 spaced a distance above the roller 36 and support surface 34 with the device draped upon a suitcase 12.

This configuration, including sleeve fastening, is most preferred, because as shown in FIG. 5, when the body portion 16 is in the engaged position as in FIGS. 4-5, it was found unexpectedly in experimentation of the travel garment device 10 herein, that in many cases once the body portion 16 is positioned in the engaged position to drape over the top of the suitcase 12, to allow insertion of the elongated handle 14 through the slot 30, that distal ends 23 of the first sleeve 20 and second sleeve 22 frequently reached the floor or contacted the rollers 36 of the rolling suitcase 12. Such potential contact is shown by the dotted line sleeve 20*a*.

While it was found that the user could take the time to roll the sleeves to be shorter to temporarily solve this issue such was not a good solution. This is because it took too much time to accomplish, and over time, due to gravity or during movement of the suitcase 12, the sleeves 20 and 22 tended to unroll causing the distal ends 23 thereof to contact the support surface 34 or rollers 36. Such contact generally went unnoticed in the busy confines of an airport or train station. Depending on the length of the sleeves 20 and 22, especially where the user of the garment has long arms, the body fasteners 26 should be spaced from the lower edge 25 of the body portion 16, such as a distance between 1-15 inches therefrom.

Figure 2:
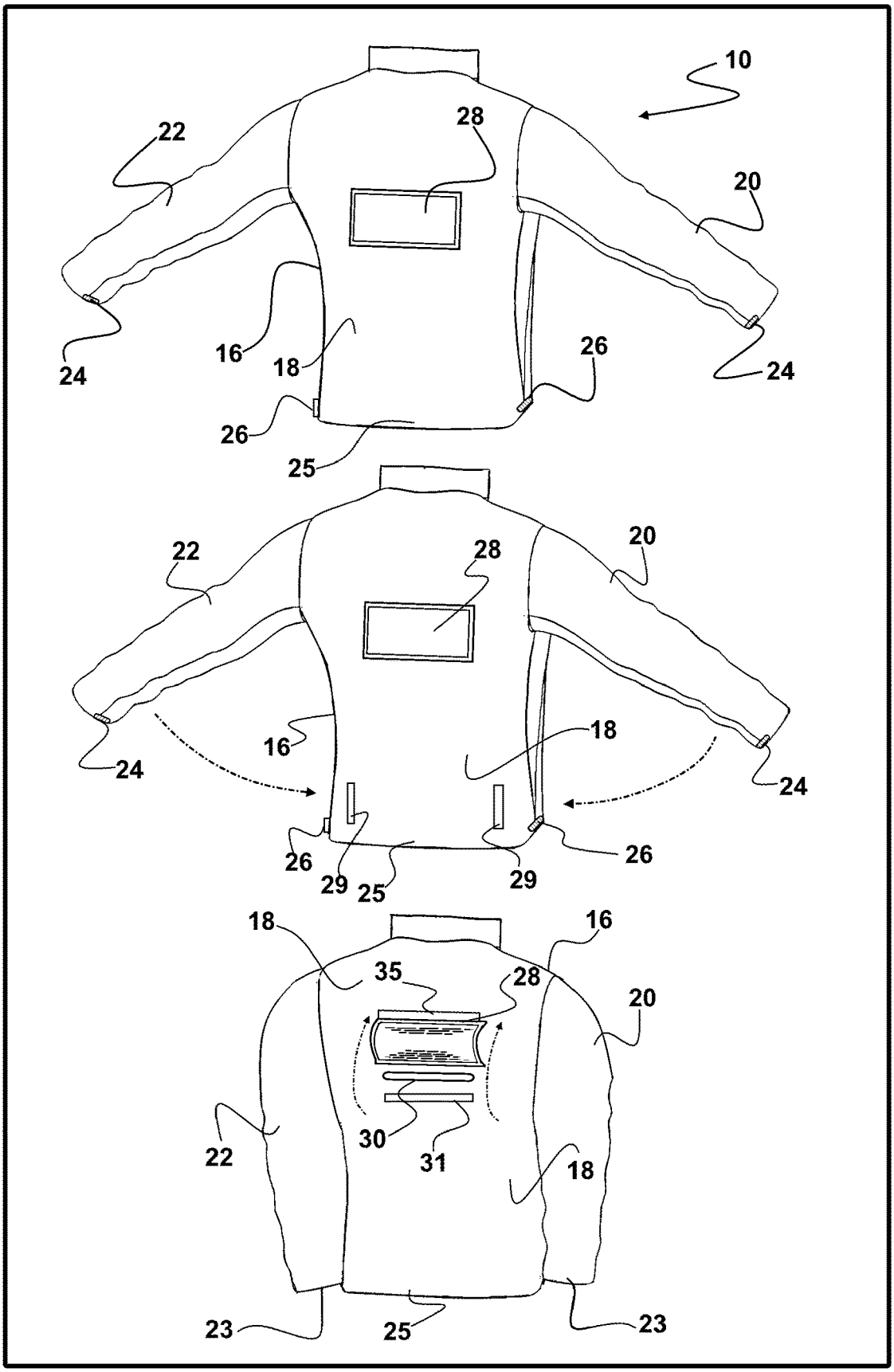
FIG. 2 shows the positions of the travel garment herein showing the removable engagement of the distal ends of the sleeves to the body fasteners or sleeve pockets in the body of the garment prior to positioning a flap to expose a slot in the garment for positioning upon the suitcase, as in FIGS. 1 and 3.
Figure 3:
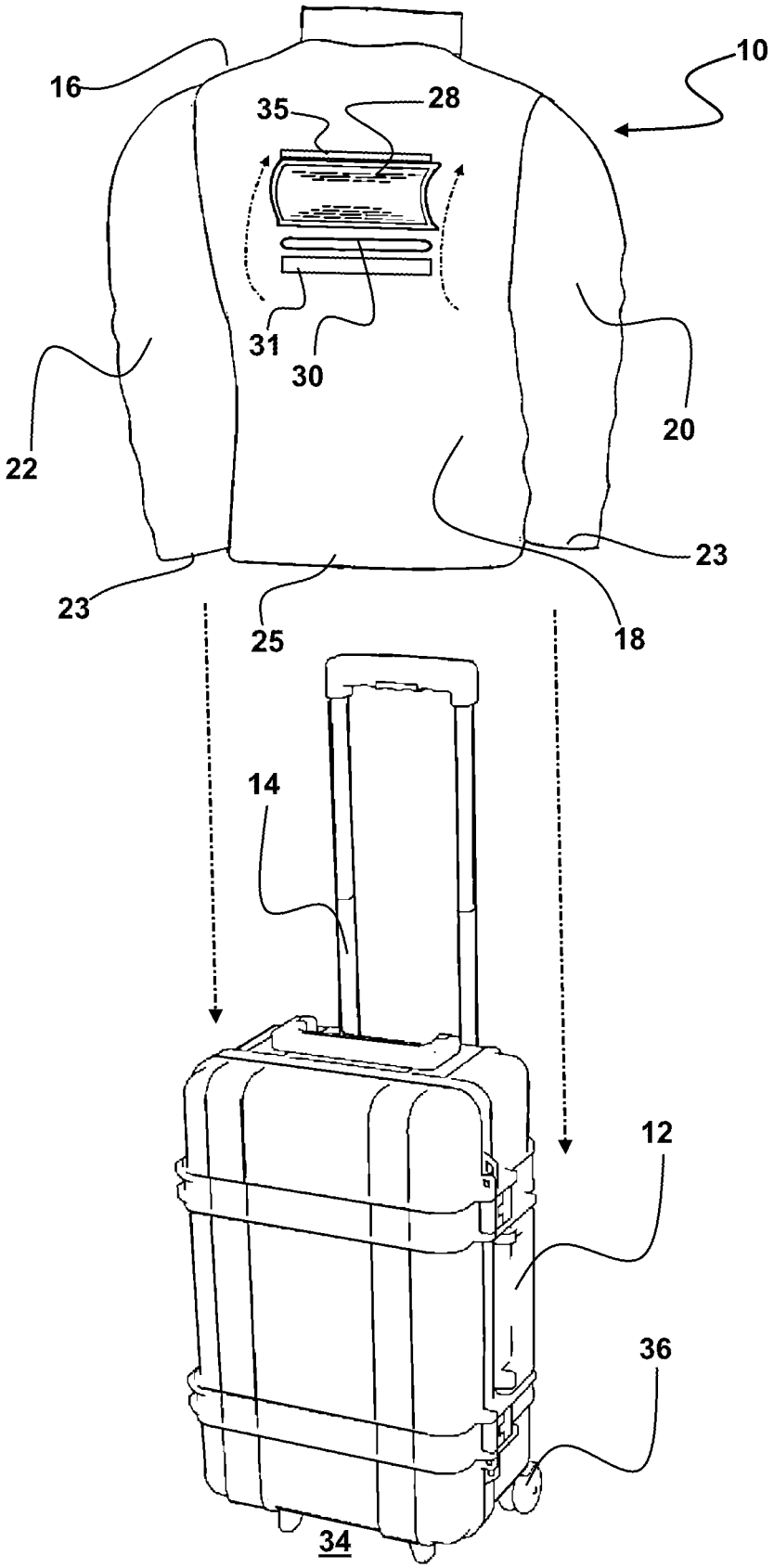
FIG. 3 depicts the step of positioning the travel garment over a suitcase by positioning the suitcase handle through the slot in the body of the garment to drape the travel garment over the suitcase or bag, as in FIG. 4.

Also shown in FIG. 1 and FIGS. 2-4 is a flap 28 which is engaged to the rear side 18 of the body portion 16. The flap 18 28 is secured to the rear side 18 along at least one side edge thereof in a fashion which will allow the flap 28 to default to a first position which covers a slot 30 (FIGS. 2-4). Such a first edge engagement, such as by sewing or using releasable fasteners, may be along an upper edge of the flap 28 where gravity will inherently pull the flap 28 to rotate downward to the first position covering the slot 30. Where securement of the flap 28 to the body portion 16 to hold it in place to cover the slot 30 is desired, releasable mating fasteners positioned on the second edge of the flap and upon the rear side 18 of the body portion, are employable. Such releasable mating fasteners are shown as hook and loop fabric 31. However, as noted herein, other releasable mating fasteners may be included on one or more edges of the flap 28 which will removably mate and engage with mating releasable fasteners such as hook and loop fabric 35 on the body portion 16. Of course releasable mating fasteners, as noted, can include buttons and button holes, snaps, magnets, and other releasable fasteners as would occur to those skilled in the art.

As noted above, indicia 32 may be positioned on the flap 28. The indicia 32 may be in the form of one or both text and drawings or artwork, and thereby adapted for advertising. Such would allow the user to receive advertising fees for wearing and using the travel garment device 10. The indicia 32 may be positioned behind a clear covering within a slot formed between the clear covering and the surface of the flap 28.

As disclosed herein, the flap 28 may be removably engaged with releasable mating fasteners along one edge, such as the upper edge as shown, to removably engage it to the body portion 16 of the travel garment device 10. Such a removable engagement may be accomplished using removably engageable connectors as the releasable mating fasteners such as hook and loop fabric, buttons and button holes, snaps and mating snaps, and other connectors. This will allow for the positioning on such travel garments of one of a plurality of different flaps 28, from a group of flaps 28 having differing indicia thereon. Alternatively, the indicia may be positioned within a pocket upon the flap 28 and changed but having a plurality of flaps 28 with differing indicia thereon is preferred.

Shown in FIG. 2 are the positions of the travel garment device 10 herein in the method for removably engaging it to a suitcase 12. As shown, the first sleeve 20 and second sleeve 22 are initially disconnected and in a wearing configuration. From this configuration, the first sleeve 20 and second sleeve 22 will be moved downward and toward the body portion 16 of the travel garment device 10. The sleeve fasteners 24 on each sleeve will be removably engaged to the mating body fasteners 26 therefor positioned on the body portion 16 of the travel garment device 10 and removably held in an elevated position. With the sleeves so removably engaged to the body portion 16 with the releasable mating fasteners, the flap 28 will be folded from the first position to the second position to reveal the underlying slot 30 to provide the user with a visual target through which to slide the elongated handle 14 of the chosen suitcase 12.

As shown in FIG. 3, with the flap 28 folded to the second position uncovering the slot 30, the user may move through the step of positioning the travel garment device 10 over the top surface of a suitcase 12. This is accomplished by positioning the suitcase handle 14 through the slot 30 in the body portion 16, preferably, from an inside surface through the slot 30 to project above the outside surface of the rear side 18 of the body portion 16.

The positioning of the slot 30, through the rear side 18 of the body portion 16, is shown in FIGS. 4 and 5, which depict the travel garment device 10 in an as-used position. As shown, the elongated handle 14 is communicating through the slot 30 in a direction from the inside surface of the rear side 18 opposite the exterior surface 19 thereof. With the elongated handle 14, so engaged, through the slot 30 and the sleeves 20 and 22 removably connected to the body portion 16, the travel garment device 10 is positioned to the engaged position where it is draped over the top surface of the suitcase 12. In this removably engaged position, the lower edge of the body portion 16 and distal ends and central areas of both sleeves 20 and 22 remain elevated above the support surface 34 on which the suitcase 12 is positioned.

If the suitcase 12 has wheels or rollers 36 (FIGS. 3 and 5), this elevated positioning keeps both the body portion 16 and the distal ends and the central areas of the sleeves 20 and 22, from contacting the support surface 34 when the suitcase 12 is rolled about. The user may thus maintain the travel garment device 10 removably draped to the engaged position upon the suitcase 12 for the duration of time they wish, thereby keeping it from being soiled, stolen, or lost while they are attending to other matters, such as eating or providing paperwork to security in an airport or the like.

This engaged position of FIG. 4 is shown in a side view in FIG. 5. As shown in FIG. 5, the preferred releasable mating fasteners, such as body fasteners 26 and sleeve fasteners 24, hold all portions of the sleeves elevated above the support surface 34 and the rollers 36. With the device, as shown in the engaged position draped upon a suitcase 12, the removable engagement of the sleeve fasteners 24 to the body fasteners 26 maintains the entire area of the two sleeves 20 and 22 in an upward curve or folded position relative to the side of the suitcase. By the term entire area is meant herein the exterior surface of either said first sleeve 20 or said second sleeve 22 extending from their respective engagement to the body portion at a first end, to a distal end 23 of each sleeve. This forms and maintains a gap between the entire area of each sleeve from the distal end 23 thereof and central areas 33 of each sleeve 20 and 22. While in this removable engagement of the sleeves 20 and 22 to the body portion, the entire area of both sleeves 20 and 22 is held elevated about the support surface when the user moves it about using the handle.

As noted, any of the different configurations and components of the travel garment shown and described herein can be employed with any other configuration or component shown and described as part of the travel garment herein. Additionally, while the disclosed travel garment invention has been described herein with reference to particular embodiments thereof and components thereof operatively engaged for operation, a latitude of equivalent modifications, various changes and substitutions are intended in the foregoing disclosures and it will be appreciated that in some instance some features, or configurations, or operations of the travel garment invention could be employed without a corresponding use of other features without departing from the scope of the invention as set forth in the following claims. All such changes, alternations and modifications as would occur to those skilled in the art subsequent to reviewing this specification, are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract included herein is neither intended to define the invention of the application, which is measured by the claims, nor is it intended to be limiting, as to the scope of the invention in any way.

What is claimed is:

1. A garment apparatus configured for removable engagement upon a suitcase in a combination therewith, comprising:

a body portion of a garment, said body portion having a rear side thereof opposite a front side thereof;

an interior area of said body portion positioned between said front side and said rear side;

a first sleeve extending from a first side of said body portion opposite a second sleeve extending from a second side of said body portion;

said rear side formed in a substantially continuous layer of material extending from a neck opening located between said first sleeve and said second sleeve to a lower edge of said body portion;

said suitcase sized for positioning within said interior area, said suitcase having a handle extendable to an elongated position from a collapsed position;

a slot communicating through said rear side, said slot providing an unobstructed view through said rear side and defining a visual target through which to slide said handle in said elongated position therethrough;

a flap coupled upon a first edge to said rear side, said flap positioned to cover said slot;

said garment having an engaged position having said elongated handle extending through said slot with said interior area of said body portion draped upon a surface of said suitcase, wherein a user of said garment can removably position said garment to said engaged position and thereafter employ said elongated handle to move said suitcase upon a support surface.

2. The garment apparatus of claim 1, additionally comprising:

a second edge of said flap opposite said first edge thereof having a releasable fastener thereon; and said releasable fastener removably engageable to a mating releasable fastener positioned on said rear side of said body portion to thereby hold said flap in a position covering said slot.

3. The garment apparatus of claim 2, additionally comprising:

a first sleeve fastener positioned upon said first sleeve adjacent a distal end thereof;

a second sleeve fastener positioned upon said second sleeve adjacent a distal end thereof;

said first sleeve fastener positionable to a first removable engagement with a first body fastener positioned upon said body portion;

said second sleeve fastener positionable to a second removable engagement with a second body fastener positioned upon said body portion;

said first sleeve fastener in said first removable engagement maintaining an entire area of said first sleeve elevated above said support surface while said body portion is in said removable engagement; and said second sleeve fastener in said second removable engagement maintaining an entire area of said second sleeve elevated above said support surface while said body portion is in said removable engagement, whereby said user can move said suitcase upon said support surface using said elongated handle and said first sleeve and said second sleeve remain elevated above said support surface.

4. The garment apparatus of claim 3, additionally comprising:

said flap being coupled upon said first edge thereof to said rear side in a removable engagement thereto;

said flap being one of a group of flaps which are configured for said removable engagement; and each flap in said group of flaps having differing indicia thereon, whereby said user can position one of said flaps from said group of flaps in said removable engagement.

5. The garment apparatus of claim 2, additionally comprising:

said flap being coupled upon said first edge thereof to said rear side in a removable engagement thereto;

said flap being one of a group of flaps which are configured for said removable engagement; and each flap in said group of flaps having differing indicia thereon, whereby said user can position one of said flaps from said group of flaps in said removable engagement.

6. The garment apparatus of claim 1, additionally comprising:

a first sleeve fastener positioned upon said first sleeve adjacent a distal end thereof;

a second sleeve fastener positioned upon said second sleeve adjacent a distal end thereof;

said first sleeve fastener positionable to a first removable engagement with a first body fastener positioned upon said body portion;

said second sleeve fastener positionable to a second removable engagement with a second body fastener positioned upon said body portion;

said first sleeve fastener in said first removable engagement maintaining an entire area of said first sleeve elevated above said support surface while said body portion is in said removable engagement; and said second sleeve fastener in said second removable engagement maintaining an entire area of said second sleeve elevated above said support surface while said body portion is in said removable engagement, whereby said user can move said suitcase upon said support surface using said elongated handle and said first sleeve and said second sleeve remain elevated above said support surface.

7. The garment apparatus of claim 1, additionally comprising:

said flap being coupled upon said first edge thereof to said rear side in a removable engagement thereto;

said flap being one of a group of flaps which are configured for said removable engagement; and each flap in said group of flaps having differing indicia thereon, whereby said user can position one of said flaps from said group of flaps in said removable engagement.

8. A garment apparatus configured for removable engagement upon a suitcase in a combination therewith, comprising:

a body portion of a garment, said body portion having a rear side thereof opposite a front side thereof;

a first sleeve extending from a first side of said body portion opposite a second sleeve extending from a second side of said body portion;

an interior area of said body portion positioned between front side and said rear side;

a slot formed into said rear side, said slot having an unobstructed view through said rear side and into said interior area of said body portion;

said suitcase sized for positioning within said interior area, said suitcase having a handle extendable to an elongated position from a collapsed position;

said slot for viewing an elongated said handle extending from said suitcase when positioned into said interior area and defining a visual target area therein through which to slide said elongated handle therethrough; and said garment having an engaged position having said elongated handle extending through said slot and with said body portion draped upon said suitcase positioned within said interior area, wherein user of said garment can removably position said garment to said engaged position and thereafter employ said elongated handle to move said suitcase upon a support surface.

9. The garment apparatus of claim 8, additionally comprising:

a first sleeve fastener positioned upon said first sleeve adjacent a distal end thereof;

a second sleeve fastener positioned upon said second sleeve adjacent a distal end thereof;

said first sleeve fastener positionable to a first removable engagement with a first body fastener positioned upon said body portion;

said second sleeve fastener positionable to a second removable engagement with a second body fastener positioned upon said body portion;

said first sleeve fastener in said first removable engagement maintaining an entire area of said first sleeve elevated above said support surface while said body portion is in said removable engagement; and said second sleeve fastener in said second removable engagement maintaining an entire area of said second sleeve elevated above said support surface while said body portion is in said removable engagement, whereby said suitcase is moveable upon said support surface using said elongated handle and said first sleeve and said second sleeve remain elevated above said support surface.

* * * * *